US006375567B1

(12) United States Patent
Acres

(10) Patent No.: US 6,375,567 B1
(45) Date of Patent: Apr. 23, 2002

(54) METHOD AND APPARATUS FOR IMPLEMENTING IN VIDEO A SECONDARY GAME RESPONSIVE TO PLAYER INTERACTION WITH A PRIMARY GAME

(75) Inventor: John F. Acres, Corvallis, OR (US)

(73) Assignee: Acres Gaming Incorporated, Las Vegas, NV (US)

( * ) Notice: Subject to any disclaimer, the term of this patent is extended or adjusted under 35 U.S.C. 154(b) by 0 days.

(21) Appl. No.: 09/104,145

(22) Filed: Jun. 23, 1998

Related U.S. Application Data

(60) Provisional application No. 60/083,299, filed on Apr. 28, 1998.

(51) Int. Cl.[7] ..... A63F 9/00

(52) U.S. Cl. ..... 463/25; 463/26; 463/27; 463/40; 463/16

(58) Field of Search ..... 463/25–30, 39–42, 463/16

(56) References Cited

U.S. PATENT DOCUMENTS

| | | | |
|---|---|---|---|
| 3,598,964 | A | 8/1971 | Dell et al. |
| 3,796,433 | A | 3/1974 | Fraley et al. |
| 3,819,186 | A | 6/1974 | Hinterstocker |
| 3,932,801 | A | 1/1976 | Peters, Jr. |
| 3,996,493 | A | 12/1976 | Davenport et al. |

(List continued on next page.)

FOREIGN PATENT DOCUMENTS

| | | |
|---|---|---|
| AU | 589158 | 8/1986 |
| AU | 649009 | 8/1991 |
| AU | 647234 | 7/1992 |
| AU | 655801 | 9/1992 |
| AU | 633469 | 1/1993 |
| AU | A-70247/96 | 4/1997 |
| EP | 0333338 | 9/1989 |
| GB | 1242296 | 8/1971 |
| GB | 2066991 | 7/1981 |
| GB | 2072395 | 9/1981 |
| GB | 2151054 | 7/1985 |
| GB | 2201821 | 9/1988 |
| GB | 2211975 | 7/1989 |
| JP | 03-326381 | 9/1993 |
| WO | WO 94/12256 | 6/1994 |
| WO | WO 95/22811 | 8/1995 |

OTHER PUBLICATIONS

M. Gyoten, K. Ito, and N. Yoshikawa, Development of an Electronic Starter for Fluorescent Lamps, Journal of the Illuminating EngineeringSociety, Summer1995,pp 86–90.

T.O. Leyh, Design Considerations for New Highly Loaded High–Frequency Fluorescent Lamp Systems, Journal of Illuminating Engineering Society, Winter 1995, pp 63–68.

E.E. Hammer, Cathode Fall Voltage Relationship with Fluorescent Lamps, Journal of the Illuminating Engineering Society, Winter 1995, pp 116–121.

*Primary Examiner*—Jessica Harrison
*Assistant Examiner*—Yveste G Cherubin
(74) *Attorney, Agent, or Firm*—Marger, Johnson & McCollom, P.C.

(57) ABSTRACT

A method for operating a group of gaming machines interconnected by a network to play both primary and secondary games from the machines. Each of the gaming machines has a primary game associated with it. Play is allowed to occur on the gaming machines while a triggering event is detected. In a preferred embodiment, the triggering event is detected by monitoring an operating parameter of the gaming machines over the network, such as total coins played. A predetermined criterion or threshold is set for the operating parameter and, if the operating parameter meets the predetermined criterion, a triggering event signal is sent through the network. Upon the occurrence of the triggering event, a secondary game is initiated from a selected one of the gaming machines whereby the secondary game is common to the group of gaming machines.

31 Claims, 5 Drawing Sheets

U.S. PATENT DOCUMENTS 4,072,930 A 2/1978 Lucero et al.
4,230,265 A 10/1980 Casaly
4,283,709 A 8/1981 Lucero et al.
4,335,809 A 6/1982 Wain
4,381,476 A 4/1983 Adachi et al.
4,399,390 A 8/1983 Oshita et al.
4,538,092 A 8/1985 Goralnik
4,582,324 A 4/1986 Koza et al.
4,652,998 A 3/1987 Koza et al.
4,679,143 A 7/1987 Hagiwara
4,689,604 A 8/1987 Sokol
4,734,623 A 3/1988 Ohkoshi et al.
4,775,937 A 10/1988 Bell
4,805,907 A 2/1989 Hagiwara
4,837,728 A 6/1989 Barrie et al.
4,839,640 A 6/1989 Ozer et al.
4,856,787 A 8/1989 Itkis
4,871,171 A 10/1989 Rivero
4,964,638 A 10/1990 Ishida
4,991,848 A 2/1991 Greenwood et al.
5,042,810 A 8/1991 Williams
5,111,115 A 5/1992 Ball et al.
5,116,055 A 5/1992 Tracy
5,123,649 A 6/1992 Tiberio
5,162,696 A 11/1992 Goodrich
5,224,706 A 7/1993 Bridgeman et al.
5,242,163 A 9/1993 Fulton
5,249,800 A 10/1993 Hilgendorf et al.
5,257,179 A 10/1993 DeMar
5,280,909 A 1/1994 Tracy
5,286,023 A 2/1994 Wood
5,332,219 A 7/1994 Marnell, II et al.
5,342,049 A 8/1994 Wichinsky et al.
5,344,144 A 9/1994 Canon
5,345,379 A 9/1994 Brous et al.
5,370,306 A 12/1994 Schulze et al.
5,393,057 A * 2/1995 Marnell, II ..... 273/85
5,401,024 A 3/1995 Simunek
5,429,361 A 7/1995 Raven et al.
5,470,079 A 11/1995 LeStrange et al.
5,472,194 A 12/1995 Breeding et al.
5,494,287 A 2/1996 Manz
5,507,489 A 4/1996 Reibel et al.
5,511,781 A 4/1996 Wood et al.
5,536,016 A 7/1996 Thompson
5,547,192 A 8/1996 Ishibashi
5,551,692 A 9/1996 Pettit et al.
5,580,309 A 12/1996 Piechowiak et al.
5,596,671 A 1/1997 Rockwell, III
5,603,659 A 2/1997 Okada
5,611,730 A 3/1997 Weiss
5,655,961 A 8/1997 Acres et al.
5,707,286 A 1/1998 Carlson
5,747,928 A 5/1998 Shanks et al.
5,823,874 A 10/1998 Adams
5,833,536 A 11/1998 Davids et al.
5,833,538 A 11/1998 Weiss
5,848,932 A 12/1998 Adams
6,012,982 A * 1/2000 Piechowiak et al. ..... 463/16
6,089,978 A * 7/2000 Adams ..... 463/20
6,135,884 A * 10/2000 Hedrick et al. ..... 463/20

* cited by examiner

METHOD AND APPARATUS FOR IMPLEMENTING IN VIDEO A SECONDARY GAME RESPONSIVE TO PLAYER INTERACTION WITH A PRIMARY GAME

RELATED APPLICATION DATA

This application claims priority from provisional application, U.S. Ser. No. 60/083,299, titled MONEY FACTORY, which was filed Apr. 28, 1998.

BACKGROUND OF THE INVENTION

This invention relates generally to electronic gaming machines interconnected by a computer network and more particularly to a method and apparatus for integrating a primary and secondary game within a computer network.

Casinos typically include electronic gaming machines (EGMs) such as slot machines and video poker machines. These games are referred to herein as the "primary game" associated with the particular gaming machine. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine and stored in the gaming machine's programmable read-on memory (PROM).

More recently, multiple gaming machines have been linked together into groups of machines that share the same bonus pool. A simple example of such a system is progressive video poker in which players play the primary poker game on one of a plurality of gaming machines grouped together on the casino floor. A coin-in counter, linked to all machines sharing the progressive pool, counts the total amount of money played in the group of machines and advances the progressive bonus pool accordingly. For instance, the casino can choose to set aside 5% of all money played on the group of video poker machines to the bonus pool. The amount of the pool is displayed on a large LED display and is incremented as money is played. This amount is awarded automatically as a bonus should a player on one of the video poker machines receive a designated winning hand such as a royal flush. After the bonus is awarded, the bonus pool is seeded with a nominal amount that is further incremented as described above.

The advantage of the progressive system is that the bonus pools from individual machines can be pooled to form larger awards, which in turn attracts more players. When taken to the extreme, progressive bonuses can be pooled together not only from machines in different areas of the casino, but also from different casinos in different states. More complex examples for bonusing are implemented using bonus servers over a network, such as disclosed in co-pending application Ser. No. 08/843,411, filed Apr. 15, 1997 and assigned to the Assignee of the present application (the '411 application), which is incorporated herein by reference for all purposes. Also incorporated herein by reference for all purposes is U.S. Pat. No. 5,655,961, assigned to the Assignee of the present application (the '961 patent), which also discloses bonuses that can be implemented by bonus servers over a network.

One drawback of the aforementioned progressive system is the preestablished nature of the bonus award whereby a triggering event (e.g. a royal flush) causes a set result (e.g. payment of the progressive jackpot). There is no further element of chance once the triggering event occurs, i.e. no secondary game is initiated by the triggering event. Furthermore, there is very little incentive for the player to continue to play the gaming machine once the triggering event occurs since his or her bonus is assured.

Some EGMs include a secondary game to supplement the primary game. The assignee of the present invention markets a gaming machine that integrates a mechanical wheel of fortune game with a single slot machine. A player of these machines would play the primary slot machine game until the symbols from the reel pull results in a particular combination that initiates the secondary game. Accordingly, the secondary game acts as a variable bonus on top of the jackpot resulting from the particular symbol combination obtained, wherein the jackpot is fixed according to the paytable stored in the gaming machine's PROM.

The coupling of mechanical elements has the disadvantage of being bulky and relatively unconfigurable. The type of secondary game and the payouts available cannot easily be changed. Additionally, such secondary games are not shared with adjoining machines so that the element of competition among players is removed and the enjoyment for spectators is limited.

Accordingly, a need remains for a better system for integrating a secondary game with a primary game over a gaming network.

SUMMARY OF THE INVENTION

It is, therefore, an object of the invention to implement a method for playing a networked secondary game from a selected one of a group of gaming machines running an individual primary game.

Another object of the invention is to integrate a large flat-panel display such as a Plasmatron™ monitor into a computer gaming network for display of the networked secondary game to primary game players and spectators.

A further object of the invention is to trigger the networked secondary game from the individual primary game machine, preferably using the same actuator as for the primary game.

Still another object of the invention is to facilitate the transfer of audit data from a networked bank of machines to a central accounting computer.

Yet another object of the invention is to encourage continued play on the gaming machines.

One aspect of the invention teaches a method for operating a group of gaming machines interconnected by a network to play both primary and secondary games from the machines. Each of the gaming machines has a primary game associated with it, e.g. Double Double Diamond slots manufactured by IGT of Reno, Nev. Play is allowed to occur on the gaming machines while a triggering event is detected. In a preferred embodiment, the triggering event is detected by monitoring an operating parameter of the gaming machines over the network, such as total coins played. A predetermined criterion or threshold is set for the operating parameter and, if the operating parameter meets the predetermined criterion, a triggering event signal is sent through the network. Upon the occurrence of the triggering event, a secondary game is initiated from a selected one of the gaming machines whereby the secondary game is common to the group of gaming machines. The secondary game is most preferably a wheel-of-fortune-type game and is displayed in common to all of the machines and local spectators on a plasma-based display monitor of the type marketed by Fujitsu under their Plasmatron™ brand. Such a monitor has a display size that measures 42" across a diagonal but is only 6" deep. Driving the plasma-based monitor is an animation computer that contains software coded animation programs for displaying the wheel-of-fortune and related audio/video events responsive to a stand-alone bonus server (SBS).

Use of the plasma-based display monitor confers several advantages over prior LED-based displays, Vacuum Fluorescent Displays (VFD), or even projection screen televisions. First, plasma-base displays take up a minimal amount of room on the casino floor where every square foot of space counts toward a casino's bottom line. Video monitors based on Liquid Crystal Display (LCD) technology also confer this advantage but are as yet not available in the desired size for casino play. Second, the number and vibrancy of colors available on plasma-based monitors, and the clarity of the picture, is unmatched in prior display technologies. Finally, the large size and uniqueness of the plasma-display, as well as the combination of a high-speed animation computer to drive the monitor, offer a great attraction to both players and spectators. It is possible, then, to visually see from each linked primary game machine the outcome of the secondary game.

In another aspect of the invention, a secondary game controller is coupled via a network to the plurality of gaming computers and plasma-based display. The secondary game controller is adapted to monitor the activity of the gaming devices over the network and causes the secondary game to initiate when the monitored operating parameter meets a predetermined criterion. An animation computer, coupled to the plasma-based monitor, is driven in response to control signals received from the secondary controller. Preferably included is an actuator on the gaming machines that can be configured by another control signal from the secondary game controller to alternately activate either the primary game on the gaming machine or the common secondary game. Also taught is a tertiary game that is initiated upon the second occurrence of the triggering event. Bonus amounts are awarded to selected machines depending upon the outcome of the secondary and tertiary games.

In yet anther aspect of the invention, a method for encouraging continued play on gaming machine is taught whereby play is allowed to occur on the gaming machine. A triggering event based on a first criterion is detected. This triggering event can take the form of either a predetermined total number of coins played since the last triggering event, a certain reel symbol or combination, or any other player-controlled or random occurrence. After the triggering event, the rate of play at the gaming machine is measured. If the rate of play meets a predetermined criterion (e.g. one coin played on average every 20 seconds), then a bonus is awarded depending upon the outcome of a tertiary game. Otherwise, if the rate of play drops below a certain threshold, then the player becomes ineligible to win the tertiary game award.

The advantage of this later aspect of the invention over the prior art is that the award of the second bonus is deferred depending upon the play speed of the player. It is in the casino's interest in the long term to get as many people to play such gaming machines as long as possible. A player who continues to play once he is guaranteed a deferred random bonus payment stands a high probability of losing some of that award back to into the bonus pool as play continues on the primary game.

The foregoing and other objects, features and advantages of the invention will become more readily apparent from the following detailed description of a preferred embodiment of the invention that proceeds with reference to the accompanying drawings.

DETAILED DESCRIPTION

Figure 1:
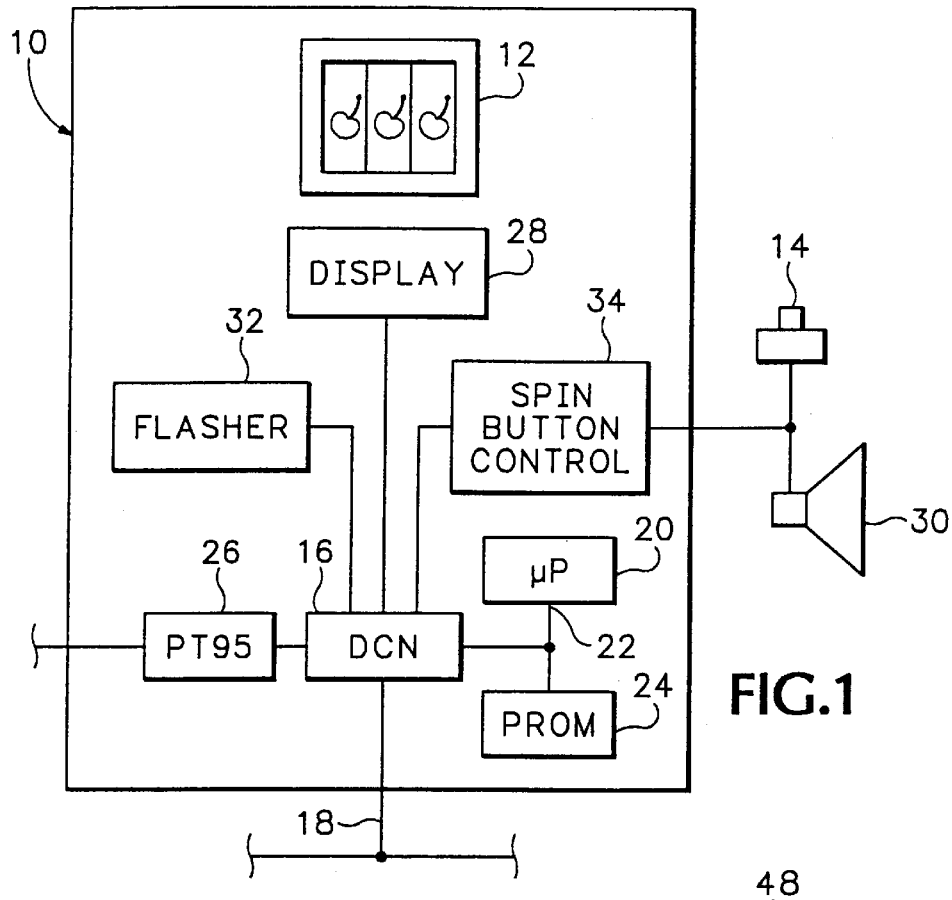
FIG. 1 is a schematic diagram of a slot machine and associated hardware implemented in accordance with the present invention.
Figure 2:
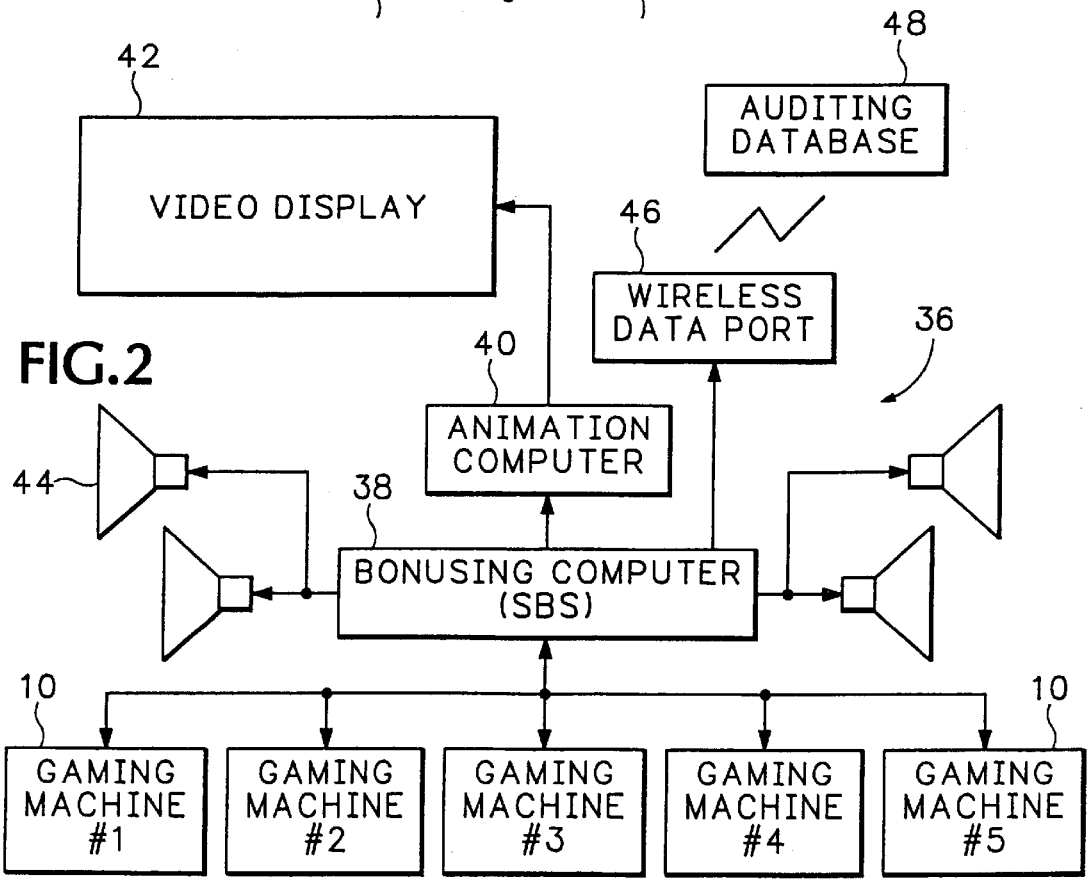
FIG. 2 is a schematic diagram of a plurality of the electronic gaming machines shown in FIG. 1 interconnected by a computer network to a secondary game in accordance with a preferred embodiment of the present invention.

FIG. 1 is a highly schematic representation of an electronic slot machine 10, which is typical of each of the primary electronic game machines (EGM) linked to the gaming network of the present invention (see FIG. 2). Each of the EGMs incorporate network communications hardware as described hereinafter. This hardware is described in the '961 patent, and is referred to therein as a data communications node (DCN). Preferably the network communications hardware is like that disclosed in the '411 application, which is referred to therein as a machine communication interface.

The EGM as shown in FIG. 1 includes a primary slot game that is configured to operate as described below. Included in EGM 10 are three reels, indicated generally at 12. Each reel includes a plurality of different symbols thereon. The reels spin independently in response to player input, such as by depressing button 14 after a wager is made, and stop spinning to present a randomly determined combination of symbols. Payouts are made automatically in accordance with a paytable stored in memory in the slot machine 10.

The network communications hardware preferably comprises a machine communication interface or data communications node (DCN) 16 as set forth in the '411 application. DCN 16 facilitates communication between the network, via connection 18, and microprocessor 20, which controls the operation of EGM 10. This communication occurs via a serial port 22 on the microprocessor to which DCN 16 is connected. Microprocessor 20 is also connected to a memory, such as programmable read only memory (PROM) 24, which includes a preset paytable for the primary game.

Each electronic gaming machine in the network preferably includes a player tracking module 26. The player tracker module can include a card reader (not shown) that reads a player-tracking card issued by the casino to individual players who choose to have such a card. The card reader and player-tracking card are known in the art, as are player-tracking systems, examples being disclosed in the '961 patent and '411 application. Briefly summarizing such a system, a player registers with the casino prior to commencing gaming. The casino issues a unique player-tracking card to the player and opens a corresponding player account that is stored on auditing database 48 (in FIG. 2) in an accounting system. The account includes the player's name and mailing address and perhaps other information of interest to the casino in connection with marketing efforts. Prior to playing one of the EGMs in FIG. 1, the player inserts his casino-issued card into the reader thus permitting the accounting system to track player activity, such as amounts wagered and won and rate of play. This information can then be used to offer complementary items or services to the player according to the total amount wagered in order to encourage the player to continue playing at the casino. Such a player tracker system is not required for the practice of the present invention since, as shown below, bonus amounts from the secondary and tertiary games are awarded to the machines themselves rather than the individuals playing the machines. However, it is understood that such player tracking can be included to award the bonus directly to the individual's account at the casino during cashless play.

Also included in the slot machine 10 are audio/visual outputs, such as a display 28, speaker 30 and flasher 32. The slot machine also includes an input device, such as player actuated button 14. Button 14 is configured to initiate the primary game, and can be configured (through spin control button 34) to initiate the secondary game as described in more detail below with reference to FIG. 5. In the alternative, a discrete second button (not shown) can be used to initiate the secondary game. The DCN 16 facilitates communication between the network and these elements to provide an interactive experience for the player.

The player display 28 is preferably a vacuum fluorescent display (VFD) known in the art which operates to display to a player on a respective gaming machine a preestablished message responsive to the state of secondary and tertiary games controlled by a bonusing computer 38 (FIG. 2). Examples of the status messages displayed on the VFD are shown below in the following table:

TABLE 1

| VFD Display Messages | |
|---|---|
| 1. | "Get ready to WIN!" (default) |
| 2. | "Get Ready to SPIN!!!" |
| 3. | Hard Coded Error Message |
| 4. | "Spin the Wheel" (Reverse Flashing) |
| 5. | Bonus Amount awarded from Secondary Game |
| 6. | "More $$$ coming soon!" |
| 7. | Bonus Amount awarded from Tertiary Game |

Each of these messages correspond to a "player state" communicated to the EGM by the bonusing computer. The messages are synchronized with signals sent to varying components of the EGM to enable the gaming machine to interact with the secondary and tertiary games according to the invention. The type of message displayed is dependent upon the state in which the gaming machine, the secondary game and the tertiary game is in as described below.

FIG. 2 shows one embodiment of the present invention implemented in a stand-alone network 36. Such a network is capable of existing by itself on a casino floor and need not be hardwired to other types of gaming machines throughout the casino. It is understood, however, that the system described below can implemented into a networked system as described in the '961 patent and the '411 application. The stand-alone system includes a plurality of gaming machines 10 coupled to a secondary game controller or stand-alone bonusing computer (SBS) 38 which controls the operation of the secondary and tertiary games. Included in the network 36 is a dedicated animation computer 40 which drives a large video display 42 according to animation states communicated to it via SBS 38, speakers 44 synchronized with the animation state, and a wireless data port 46 for communicating accounting data to an auditing database 48 as described further below.

The animation computer 40 can be any medium-powered computer such as one having an Intel Pentium II 266 processor, 256 MB SDRAM, a Matrox Millenium II 4 MB graphics card, CD ROM drive, 4 GB hard drive, and sound card. Gaming regulations typically require that modifiable media (e.g., hard-drive, flash BIOS, etc.) should have no impact on the outcome of the game. As the animation computer has these elements, the animation computer is configured to display a state as defined by the bonusing computer 38. It is understood, however, that as processing speed increases and computers become more powerful, it is foreseen that responsibilities for such animation can be accomplished by the processor in the bonusing computer or other devices on the network.

The video display device 42 can be any of the type of devices drivable by the animation computer to display the animation sequences described below. Examples include cathode ray tubes (CRTs), liquid crystal displays, plasma display panels (PDPs) or any other known or anticipated video monitor.

The preferred type of display 42 is the plasma-based display monitor such as the type marketed by Fujitsu under their Plasmatron™ brand. Such a monitor has a display size that measures 42" across a diagonal but is only 6" deep. Use of the plasma-based display monitor confers several advantages over prior LED-based displays, Vacuum Fluorescent Displays (VFD), or even projection screen televisions. First, plasma-base displays take up a minimal amount of room on the casino floor where every square foot of space counts toward a casino's bottom line. Video monitors based on Liquid Crystal Display (LCD) technology also confer this advantage but are as yet not available in the desired size for casino play. Second, the number and vibrancy of colors available on plasma-based monitors, and the clarity of the picture, is unmatched in prior display technologies. Finally, the large size and uniqueness of the plasma-display, as well as the combination of a high-speed animation computer to drive the monitor, offer a great attraction to both players and spectators. It is possible, then, to visually see from each linked primary game machine the outcome of the secondary game.

The bonusing computer 38 provides the central control mechanism for the stand-alone system. Communication with the various components of the stand-alone system 36 is described below.

Communication Between the SBS and the Gaming Machines

Play on each of the gaming machines determines the operating parameters of the machines. Exemplary parameters include: the rate of play on the machine, the total coins played, whether a maximum bet has been made, etc. These operating parameters are collected and sent through the network to the SBS 38 via each gaming machine's data control node 16. The SBS 38 collects this data and compares them to preestablished criteria to determine whether a triggering event occurs. Examples of preestablished criteria are the total number of coins played across all machines from the last triggering event and the minimum rate of play.

Figure 3:
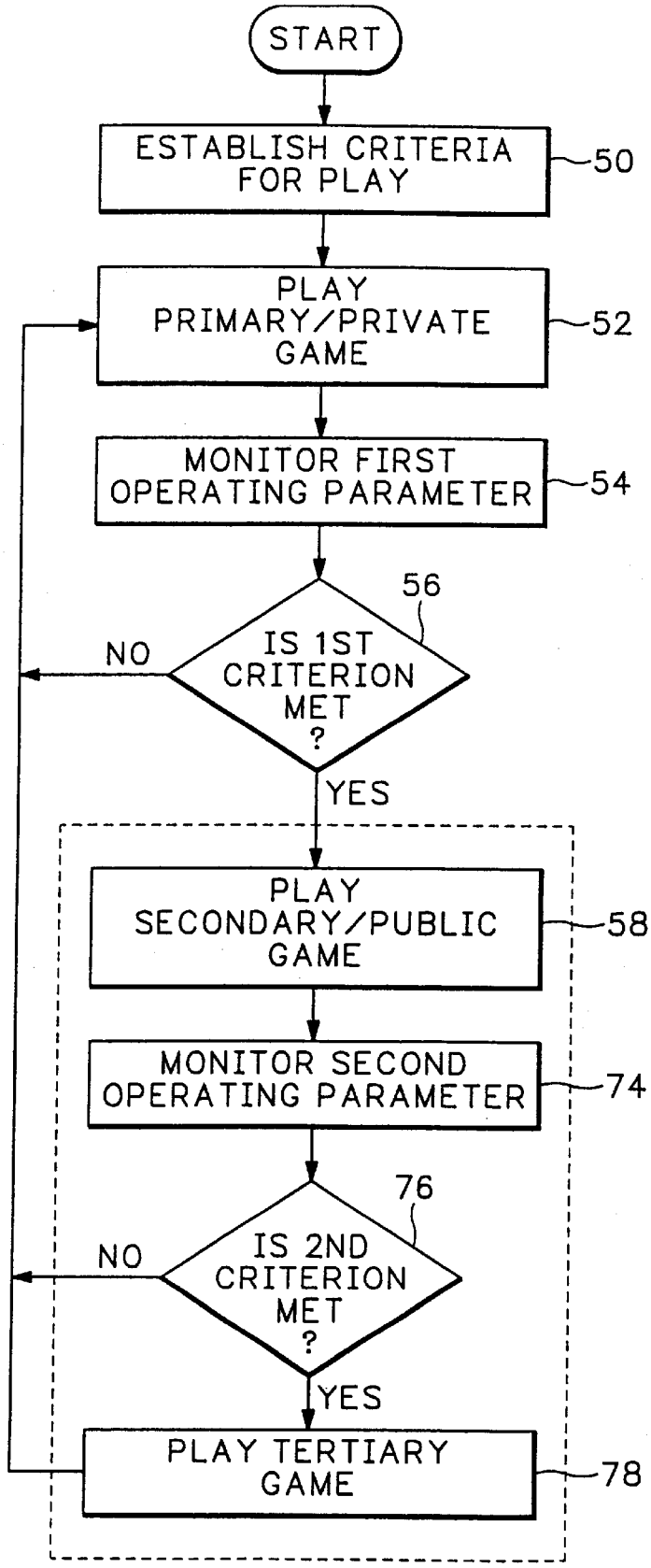
FIG. 3 is a flow chart that depicts the operation of the FIG. 2 network in accordance with the present invention.

FIG. 3 broadly illustrates the preferred method in which the primary and secondary (and optionally the tertiary) games operate across the network. In step 50, triggering event criteria are programmed into a memory on the bonusing computer 38 and play is allowed to occur on the primary game of the gaming machines (step 52).

During this normal state, message #1 (shown in Table 1 above) is displayed on the VFD 28 (FIG. 1) as the player plays the primary game.

During play, the operating parameters of the gaming machines are monitored over the network in step 54. One preferred example of this is the monitoring of the number of coins or credits played from the group of gaming machines as a whole. After each coin or credit is played at a particular gaming machine of the group, a signal is sent to the bonusing computer communicating the coin drop event and the gaming machine identification. Alternately, the coin or credit played signal can be sent to the bonusing computer after all coins have been played and the spin button 14 (FIG. 1) is depressed. Each coin drop or credit played and communicated to the bonusing computer advances a counter (not shown) common to the group of gaming machines. Whenever a monitored operating parameter of the gaming machines meets the predetermined criterion (step 56 inquiry), a "triggering event" occurs and a triggering event signal is sent through the network to the selected gaming machine which caused the triggering event (e.g., on which the 200th coin was played). The, triggering event causes the secondary game to start (step 58) according to the methods outlined below.

In another aspect of the invention, the triggering event occurs when a player obtains a certain reel symbol or combination. In one example, the player obtains a combination that includes a special bonus initiator symbol linked to play on the secondary or tertiary game.

In the preferred embodiment, the apparatus for implementing the invention comprises five wide body, "chop top" IGT Double Double Diamond S+ slow machines, with the international bill acceptor. The top cabinet of the game will vary in size depending on the player tracking system of the installation site. In areas where the casino's player tracking system requires a 2 inch mounting bracket, the top box will be 11 inches tall. In casinos where the player tracking bracket is 3 inches, the top box will be 12 inches tall. The pay table for the primary games will be contained in both the top glass and belly glass. Behind both sets of glass will be fluorescent flashers.

The Spin Reel button located on the control panel beneath the reel glass will be a larger version button and will flash notifying the player that it is time to spin the wheel. A logo for this button will be designed signifying that the button serves as both the reel spin and wheel spin button. The flashing of the spin wheel button will be configurable.

The DCN+ used in the preferred embodiment of the invention is based on the automatic bonusing system (ABS) DCN+ manufactured by Acres Gaming or Corvallis, Oregon with the addition of the following specific items needed to support the game:

A new family of messages is introduced by the SBS: the "standalone bonus server to DCN passthrough". These messages provide a transport and container mechanism for messages to be sent from the Bonusing Computer 38 to the DCN 16 without any other piece of the system (concentrator, bank controller, . . . ) having any knowledge of their meaning. All GameX specific messages will belong to that family messages.

The DCN will support a "GameX session" mode, triggered by a message containing the following information:

TABLE 2

| Data Sent | | |
|---|---|---|
| 1. | BonusId | identifies the bonus server to the DCN |
| 2. | HitNumber | identifies the bonus instance to the DCN |
| 3. | CSId | "Control String" ID to display (i.e. message to display) |
| 4. | Timeout | timeout before sending "spin" event automatically |
| 5. | FlashRate | Rate at which the spin button and fluorescent flasher flashes |
| 6. | BeepRate | Rate of enunciator beep |
| 7. | Lock Flag | indicates whether to lock the game or not for the bonus pay |

This message can be sent several times with different parameters. For example when it is time for the player to press the SPIN button, the message is sent with flashrate on and a CSId requesting the "press SPIN now" string. Once the SBS has received the "button pressed" event and the wheel is spinning, it then sends a message with flashrate sent to "don't flash" and a CSId requesting the "get ready to win" message.

In addition, when the system is not integrated within an ABS, all player tracking an carded bonuses will be removed from the DCN because they're not needed and the code space is needed to make room for the SAS 3.x port replicator.

Communication Between the SBS and Animation Computer

The communication protocol between the SBS 30 and animation computer 40 is comparative with the Local OL protocol, allowing overhead displays, card readers and animation computers to co-habitate on the same link. Animation computers use a protocol ID of 0×85. The protocol is polled, allowing the animation computer 40 to send a feedback message to the SBS 38, such as "animation sequence finished", rather than relying on timing to synchronize the SBS actions with the animation. The protocol is "state based", i.e. the SBS continuously informs the display of the state is should be in. This allows the system to occasionally miss a message without any impact on the animation. The animation computer can have an address that will be used when the system is integrated with any network-wide bonusing scheme. There can be several animation computers on one link, so the messages include an "animation computer ID" byte. The messages will carry a "pay table ID", to make sure that the animation computer's art and program match the information stored on the SBS. The SBS message can also carry a "volume control" byte allowing one to select overall playback volume. In case of code mismatch, the Animation Computer will go in an error mode.

When the counter reaches a predetermined criterion based on the inquiry of step 56 (e.g. the $200^{th}$ coin played), a signal is sent from the SBS 38 to the animation computer 40 to begin the spin up animation sequence. Such an occurrence is called the "triggering event". The triggered animation sequence has the following features, each implemented in software-coded programs stored on the animation computer:

TABLE 3

| Animation Sequence | |
|---|---|
| 1. | Wheel at Rest |
| 2. | Icon of Selected Game Drops into Queue |

TABLE 3-continued

| Animation Sequence | |
|---|---|
| 3. | Animated Gears Turning -- Wheel Ready to Spin |
| 4. | Large Wheel Spinning |
| 5. | Large Wheel Spun |
| 6. | Coins Fall Indicating First Bonus Awarded |
| 7. | Small Wheel Spun |
| 8. | Coins Fall Indicating Second Bonus Awarded |

A signal is sent to the gaming machine responsible for the triggering event (e.g. the machine at which the 200th coin is played) which changes the VFD 28 to display message #2 (shown in Table 1). Such a signal can be directed using methods known in the art such as by assigning an IP address to the gaming machine DCN 16.

Figure 6:
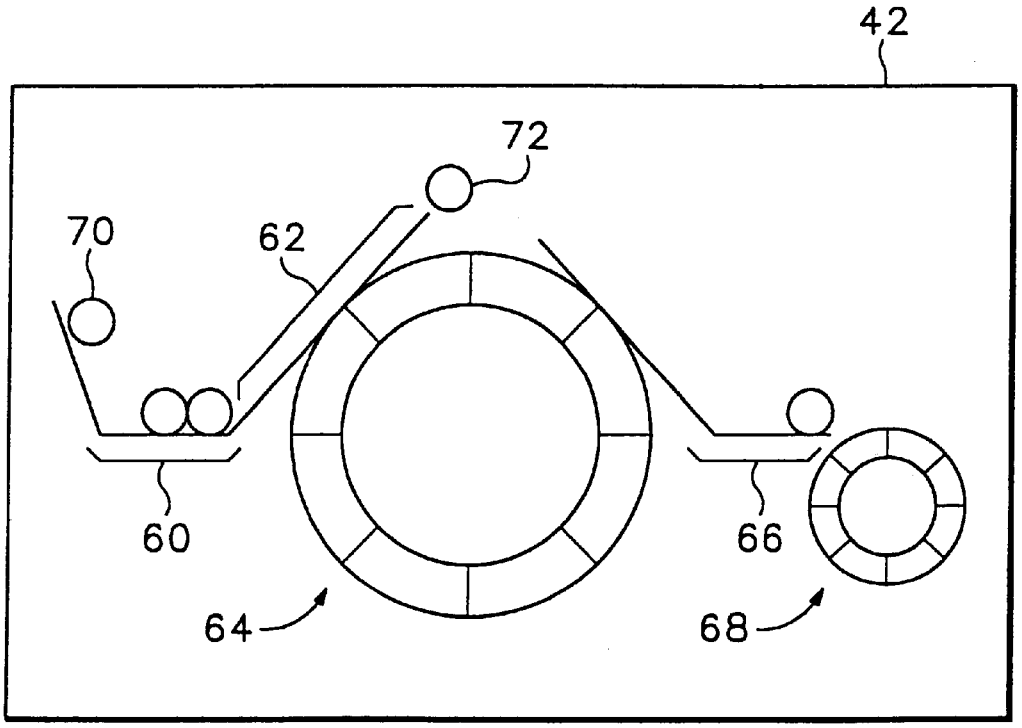
FIG. 6 illustrates a preferred embodiment of a secondary and tertiary game as displayed on a video monitor.

A description of the animation sequences as described above will now be explained with reference to FIG. 6. FIG. 6 illustrates the secondary and tertiary game as displayed on the large video display monitor 42 coupled to the networked gaming machines 10. The secondary game includes a secondary game line-up area 60, a conveyer 62, a large multi-segmented wheel 64, a tertiary game line-up area 66, and a second (smaller) multisegmented wheel 68. The preferred format of the secondary game is the "wheel-of-fortune" type of game as shown in FIG. 6 in which the secondary game wheel has a plurality of segments which each correspond to a bonus award. It is understood, however, that the secondary game can take a variety of configurable forms and should not be limited to the type of game shown in FIG. 6 and described below. For instance, the multisegmented wheel could be fixed and the pointed could travel around the periphery much like a ball travels around the periphery of a roulette wheel.

Prior to the triggering event, the SBS 38 communicates a "wheel at rest" state (#1 in Table 3) to the animation computer 40 which in turn runs the animation subprogram associated with that state until a state change. In such an animation, coins can be seen to fall from slots on the sides of the large wheel 64 while gears in the far background turn in slow, incremental steps. Low industrial sounds can be heard coming from speakers 44 (FIG. 2).

If a player at a particular gaming machine on the network causes a triggering event by, for instance, inserting the 200th coin, then a triggering signal is sent through the network to change the message shown on VFD 38 of the selected machine as well as instruct the animation computer to begin a new animation sequence. In one example of this animation sequence (#2 in Table 3), a player icon representative of the one gaming machine selected rolls onto the screen from the left of the display screen 42 and down a ramp into the secondary game line-up area 60. FIG. 6 illustrates this icon as circle 70 that could include within it the number of the selected machine. For instance, if the player at gaming machine #3 (out of the five total gaming machines 10 on the stand-alone network 36) inserted the 200th coin, then the icon 70 would have displayed a '3' within it. Once the icon 70 is in the secondary game line-up area 60, the icon waits in a queue (shown by two adjacent icons lined up adjacent the ramp 62). The front icon in the queue (such as icon 72) moves up the conveyer 62 until it is positioned over the wheel 64 in a spin position.

Once the front icon 72 has moved to the spin position at the top of wheel 64, the "waiting to spin" animation sequence begins. In this sequence (#3 in Table 3), animated gears coupled to the wheel 64 begin to accelerate, a spin light on the selected gaming machine begins to flash red to indicate that the button should be pressed to initiate the secondary game. Accompanying sounds are played to build up the suspense of starting the secondary game.

When the button is pressed or after a predetermined amount of time, yet another animation sequence (#4 in Table 3) is started in which the secondary game wheel itself starts to spin. The secondary game wheel spins for different durations depending on the time period at which the button was activated and comes to rest with one of the bonus amount segments having been selected. The smaller wheel 68 also starts to spin during this time.

After the large wheel comes to rest, the bonus indicated by the outcome of the secondary game is paid out to the selected machine. The payoff animation sequence (#6 in Table 3) shows, for instance, many coins falling from a slot on the left side of the wheel accompanied by a variety of different sounds indicative of the size of the award. The volume level can be increased for larger awards. The amount of the award and the chance of receiving it can be configured by the casino operators using methods described in more detail below. Payoff is completed by sending a bonus signal to the selected gaming machine's DCN 16 (FIG. 1) which increases the credit account on that machine by the amount indicated by the award. Such signaling techniques are described in detail in the '961 patent and '411 application.

After the bonus for the secondary game is allocated, the player icon 72 of the selected machine is forcibly ejected from its position over the wheel 64 so that it rolls down a ramp into the tertiary game line-up area 66. The tertiary game occurs during the very next occurrence of the triggering event (e.g. the 400th coin-in). The SBS 38 monitors a second operating parameter (step 74 in FIG. 3) of the gaming machine 10 whose icon is located in the tertiary game line-up area and compares this second operating parameter to a second preestablished criterion (step 76 in FIG. 3). In a preferred embodiment of the invention, the rate of play of the selected machine is monitored by the SBS. If the rate of play falls below the preestablished criterion (e.g. greater than twenty second delay between coin-in events), then the player is deemed ineligible to win the bonus award from the outcome of the tertiary game. When the player becomes ineligible, the player's icon is forcible ejected from the tertiary game line-up area and appears to fall off of the video display monitor 42. If the player remains eligible until the second occurrence of the triggering event, then the player is allowed to play the tertiary game (step 78). The tertiary game operates much like the secondary game whereby the smaller wheel 68 spins up and down similar to the larger wheel 64. A bonus is then awarded based on an outcome of the tertiary game.

Figure 4A:
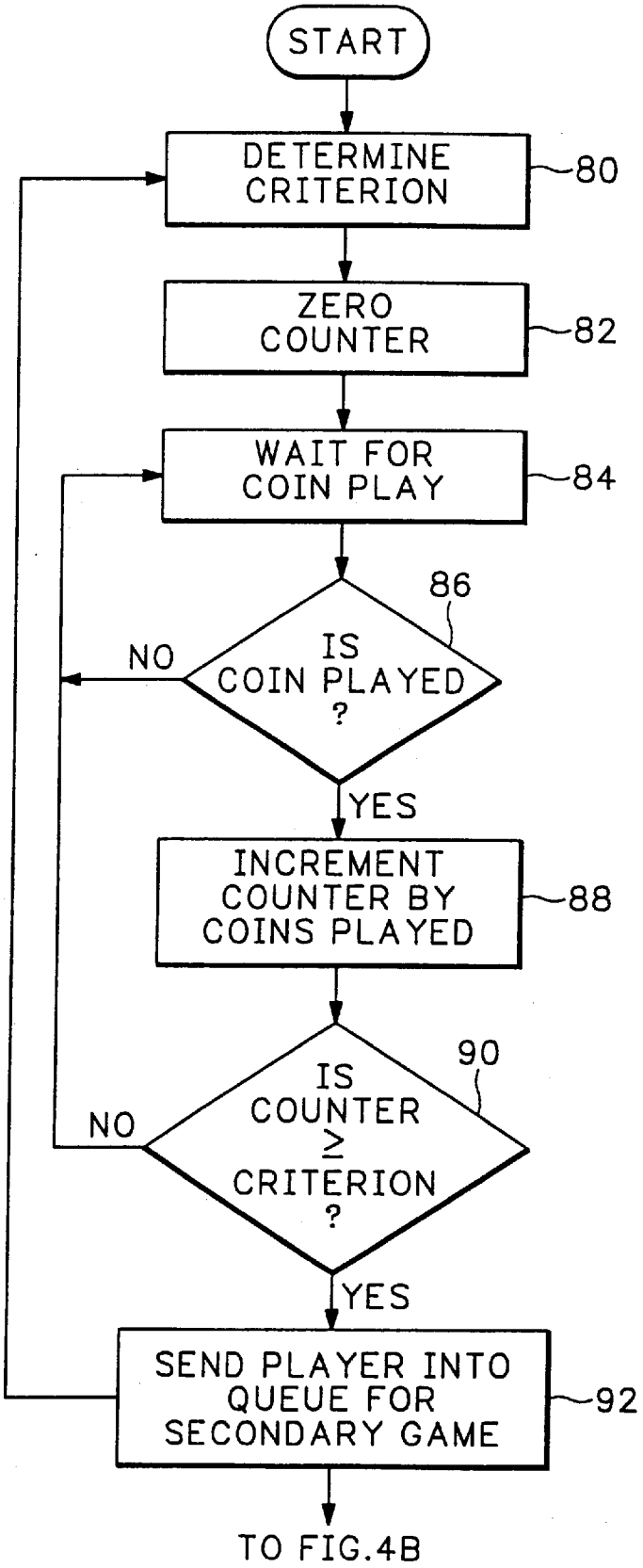
FIGS. 4A and 4B are flow diagrams depicting in more detail the implementation of the secondary game over the network of FIG. 2.
Figure 4B:
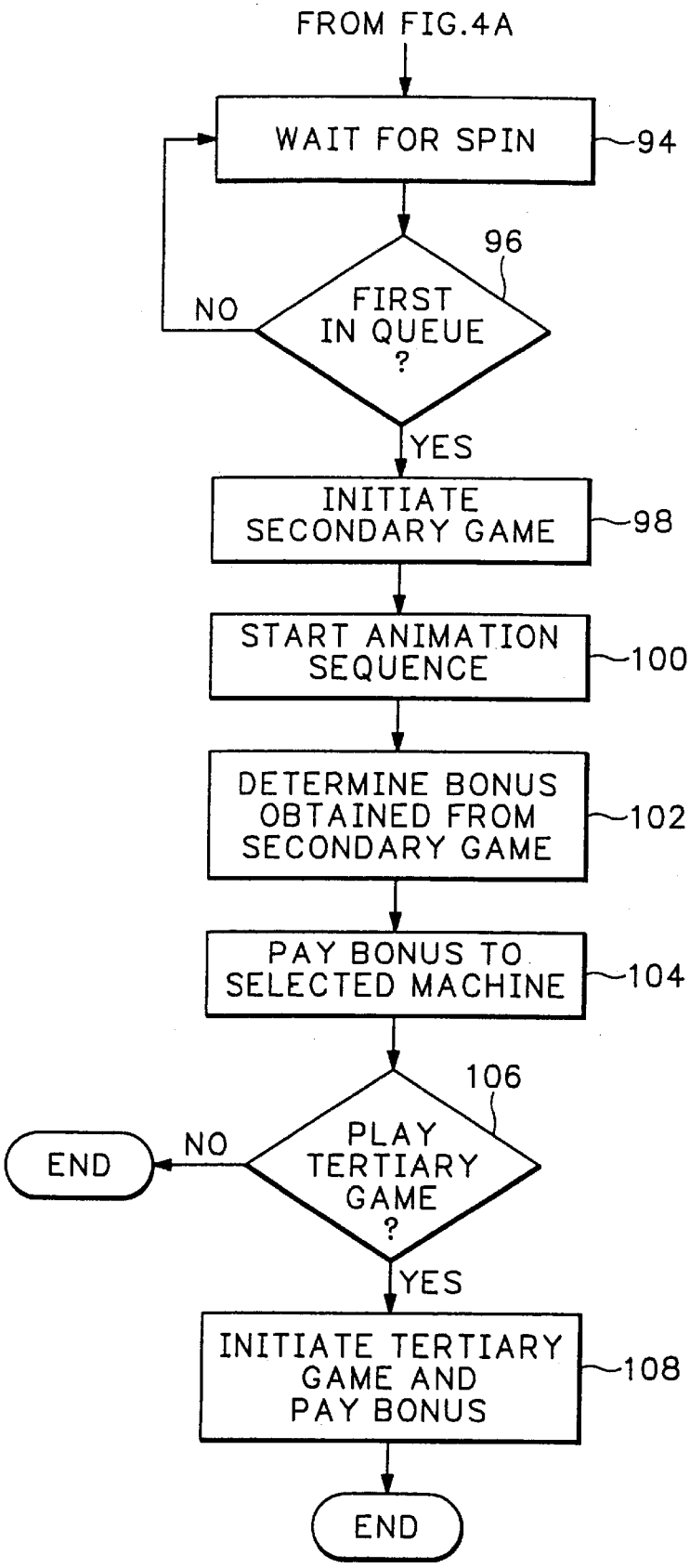

FIGS. 4A and 4B show a flow chart illustrating this sequence in more detail. In step 80, criterion of play is determined such as the total number of coins played before a triggering event occurs. This can either be a fixed criterion (e.g. the 200th coin played) or a semi-random criterion (the xth coin played where x is a randomly generated number between 200 and 800). A coin-in counter is zeroed in step 82 and play of the primary game on the plurality of gaming machines commences. The operating parameters of the gaming machines are monitored to detect a coin play (step 84). If a coin is played (step 86), then a counter at the SBS is incremented by the number of coins played (step 88). A comparison is made in step 90 between the counter and the criterion established. If the criterion is satisfied, then the player responsible for the triggering event is sent into a queue for the secondary game (step 92).

Once in the secondary game queue, the player is put into a wait state (step 94) until the player's icon is moved to the front of the cue (step 96). While in this wait state, the player can still continue to play the primary game on the gaming machine. Once the secondary game is ready to begin for the selected player, the secondary game is initiated (step 98) as by actuating button 14 and the animation sequence for the game is displayed on the video monitor (step 100). A bonus amount is determined from the outcome of the game (step 102) based on a semi-randomly determined amount stored in memory in a lookup table and the amount is paid to the selected machine (step 104). Eligibility for the tertiary game is determined by monitoring a rate of play operating parameter of the selected machine (step 106). If the rate of play meets or exceeds the predetermined rate of play criterion, then the player is allowed to initiate the tertiary game (step 108) and gain the bonus award. Otherwise, the gaming sequence ends and the player keeps playing the primary game.

Gaming Machine Spin Button Configuration

Figure 5:
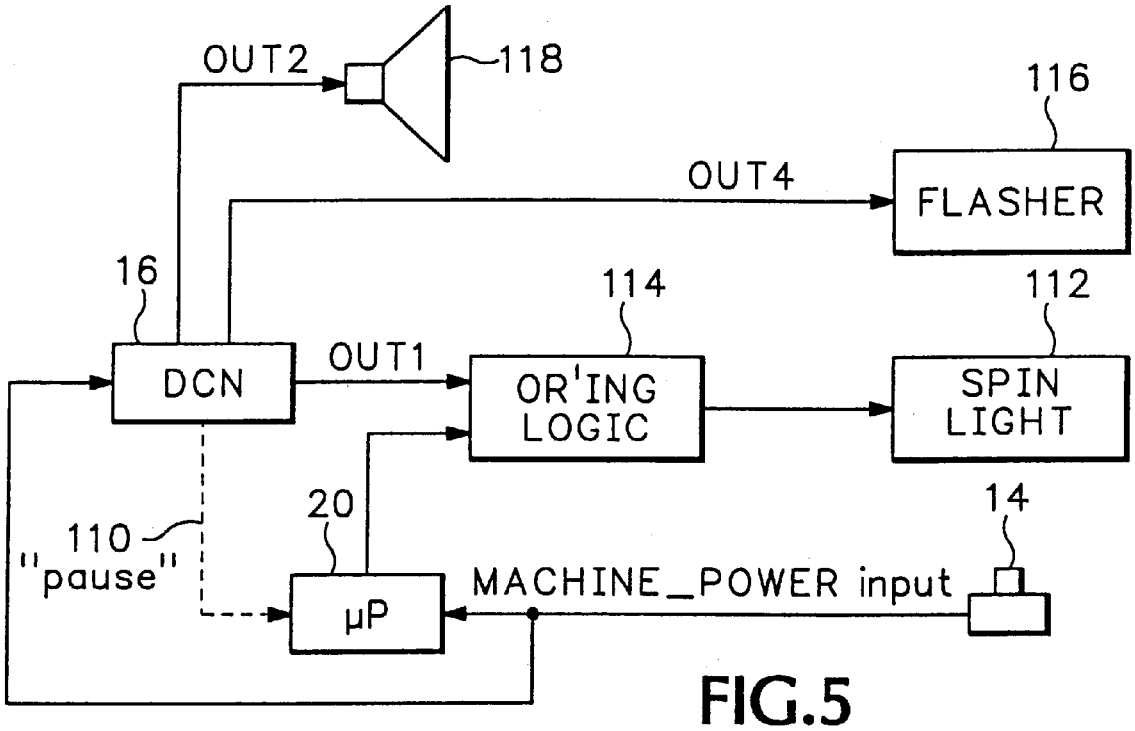
FIG. 5 is a schematic diagram of the spin button controller implemented according to a preferred embodiment of the slot machine of FIG. 1.

Referring now to FIG. 5, the actuator used to initiate the primary slot machine game in the preferred embodiment is a "spin" button 14 located on the front console of the gaming machine. Spin button 14 is preferably the same button used to initiate the primary game (e.g. the slot machine). This arrangement is preferred because conventional gaming machines can be used without changing the exterior buttons; only the DCN 16 and a spin button control 34 as described below need to be added. However, it is understood that a discrete second button on the gaming machine can be used to initiate the secondary game without departing from the spirit of the invention.

Under normal operation, pressing the button sends a signal to the primary game board microprocessor 20 to start the gaming sequence, e.g. start and then stop after a random time the spinning of the reels of the primary game. When the secondary game is called for by events described above, the DCN sends a deactivation signal such as a "pause" command to the primary game (shown by dashed line 110). The pause command causes the primary game microprocessor 20 to turn the gaming machine's spin light 112 off, and to ignore the activation of its own spin button to initiate the primary game. When prompted by the Bonusing Computer 38, the DCN sends a signal along signal line OUT1 through an OR logic gate 114 to flash the machine's SPIN light, and sense the SPIN switch. When it senses the switch has been pressed, it sends an event to the Bonusing Computer 38 (FIG. 2) via connection 18 (FIG. 1) which initiates the secondary game.

The debouncing of the switch 14 is preferably configured to ensure that the "button pressed" signal lasts several milliseconds so that the DCN 16 has time to detect it through the MACHINE_POWER input line. the signal is then routed to the Bonusing Computer 38 which then initiates the secondary game. Other control outputs from the DCN 16 are made along signal lines OUT4 and OUT2 which control the flasher 116 and enunciator 118, respectively. The enunciator control is configured to make a sound in response to a signal from DCN 16 to grab the player's attention when it is time to initiate the secondary game by pressing the spin button 14.

Configuration Workstation

The configuration workstation allows the game operator to pick a pay table in a list of predefined pay tables. The predefined pay tables are stored in a file on the configuration workstation such as on a floppy disk or PC Card on a small portable computer such as the Libretto™ manufactured by Toshiba. Examples of parameters that can be adjusted are: the number of segments of the big wheel, the bonus amount associated with each segment of the big wheel, the percentage chance of hitting each segment of the big wheel, the number of segments of the small wheel, the amount written on each segment, and the percentage chance of hitting each of the segments. This list is not intended to be complete as it is understood that many other gaming parameters can be adjusted using the configuration workstation.

The configuration workstation can be connected over an Ethernet link to the bonusing computer. Preferably, however, the configuration computer and bonusing computer are outfitted with complementary IrDA ports for transmitting and receiving wireless signals. Access to configuration parameters should be password protected for security reasons.

The bonusing computer is preferably configured to continuously broadcast the data needed for reports over its IrDA. These signals can include audit data (if the Bonusing computer is not hardwired to an accounting computer) detailing the pool name, meter readings for each of the machines and the machines cumulatively, the number of hits on each segment of the wheel, etc.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A method for operating a group of gaming machines interconnected by a network comprising the steps of:

allowing play to simultaneously occur on the gaming machines, each of said gaining machines having a primary game associated therewith;

detecting a triggering event;

initiating a single secondary game from one of the gaming machines after the occurrence of the triggering event, said single secondary game being common to the group of gaming machines and resulting in an outcome; and paying a first bonus responsive to the outcome of the secondary game.

2. The method of claim 1, wherein the step of detecting a triggering event comprises:

monitoring an operating parameter of the gaming machines over the network;

establishing a predetermined criterion for the operating parameter; and sending a triggering event signal through the network when the operating parameter meets the predetermined criterion.

3. The method of claim 2 further including:

selecting one of the machines when the operating parameter meets the predetermined criterion; and initiating the secondary game from the selected machine.

4. The method of claim 2 wherein the operating parameter is the total amount of coins played on the group of gaming machines, and the criterion is a predetermined number of coins.

5. The method of claim 2 wherein the operating parameter is the total amount of money played on the gaming machines, and the criterion is a predetermined amount of money.

6. The method of claim 2 further including zeroing the monitored operating parameter after the operating parameter meets the predetermined criterion.

7. The method of claim 2, further including:

initiating a tertiary game responsive to a second triggering event; and paying out a second bonus responsive to an outcome of the tertiary game.

8. The method of claim 3 further including paying the first bonus to the selected machine responsive to the outcome of the secondary game.

9. The method of claim 3 further including:

providing an actuator at each of the gaming machines for initiating the primary game;

sending a deactivation signal to the selected gaming machine;

disabling the actuator of the selected gaming machine, responsive to the deactivation signal, so that the actuator does not initiate the primary game; and using the actuator to initiate the secondary game.

10. The method of claim 3 wherein the secondary game comprises a multisegmented wheel, each segment of the wheel having a predetermined bonus amount associated therewith, said method further including:

displaying a multisegmented wheel on a video display device;

initiating a control signal for the secondary game from the selected gaming machine, said control signal determining a bonus payment displayed on one of the segments of the wheel; and paying out a bonus to the selected gaming machine responsive to said initiated control signal.

11. The method of claim 3 further including displaying a status message on the selected gaming machine responsive to the secondary game.

12. The method of claim 7 further including:

monitoring a second operating parameter of the selected gaming machine over the network;

establishing a second predetermined criterion; and sending a second triggering event signal through the network when the second operating parameter meets the second predetermined criterion.

13. The method of claim 1 further including displaying the secondary game on a plasma-based flat panel video display device in common with the group of gaming machines.

14. The method of claim 1 in which the triggering event is an occurrence of a predetermined reel combination on one of the group of gaming machines.

15. An apparatus for selectively operating a plurality of machines over a network, said apparatus comprising:

a plurality of gaming machines for playing a primary game thereon;

an actuator coupled to each of the gaming machines for selective activation of the primary game by a player at a respective gaming machine;

a secondary game controller;

a network coupled to the gaming devices and the controller for exchanging data between the secondary game controller and the gaming devices;

a secondary game adapted to be initiated responsive to signals from the secondary game controller;

wherein the secondary game controller monitors the activity of the gaming devices over the network and causes the secondary game to initiate when an operating parameter meets a predetermined criterion; the apparatus further including means for selecting one of the plurality of game machines when the operating parameter meets the criterion; and means on said selected machine for initiating said secondary game, wherein said secondary game controller applies a first bonus to the selected machine responsive to an outcome of the secondary game.

16. The apparatus according to claim 15 further including:

a plasma display monitor coupled to the secondary game controller for displaying the secondary game responsive to signals from the secondary game controller.

17. The apparatus according to claim 16 further including an animation computer coupled to the plasma display monitor for driving the video display responsive to the secondary game controller.

18. The apparatus according to claim 15 further including a configuration workstation remotely coupled to the secondary game controller over the network for remotely changing the predetermined criterion.

19. The apparatus according to claim 15 further including a wireless data port coupled to the network for transmitting audit data to a remote wireless receiver.

20. The apparatus according to claim 15 further including:

a play counter for counting the total number of coins played across the plurality of gaming machines, wherein the criterion is a predetermined number of coins.

21. The apparatus according to claim 15 further including a video display device coupled to the secondary game controller for displaying the secondary game responsive to signals from the secondary game controller.

22. The apparatus according to claim 15 further including a liquid crystal display (LCD) device coupled to the secondary game controller for displaying the secondary game responsive to signals form the secondary game controller.

23. The apparatus according to claim 15 further including:

a play counter for counting the total amount of money played across the plurality of gaming machines, wherein the criterion is a predetermined amount of money.

24. A method for operating a gaming machine comprising the steps of:

allowing play to occur on the gaming machine;

detecting a triggering event based on a first criteria;

measuring a rate of play at the gaming machine; and awarding a bonus after a second occurrence of the triggering event if the measured rate of play at the gaming machine meets a predetermined criteria.

25. The method of claim 24 further comprising:

allowing play to occur at a plurality of other gaming machines; and initiating a secondary game from a selected one of the gaming machines responsive to the triggering event.

26. The method of claim 25 further comprising:

placing the selected gaming machine in a queue to play the secondary game responsive to the triggering event, wherein the second game can be initiated from the selected gaming machine only if the selected machine is at the front of the queue; and awarding a secondary game bonus to the selected machine responsive to an outcome of the secondary game.

27. The method of claim 25 further comprising:

initiating a tertiary game responsive to the secondary occurrence of the triggering event; and awarding the bonus to the selected gaming machine based on an outcome of the tertiary game.

28. A method for operating a gaming device configured to play a primary game comprising the steps of:

providing a plurality of gaming machines having a primary game associated therewith;

coupling the gaming machines to a common video display device;

displaying a bonus amount on the video display device;

permitting players to play the primary game at the gaming machines;

monitoring at least one variable related to user-controlled play on the gaming machines;

establishing a predetermined criterion for one of said variables;

selecting one of the machines when said one variable meets the criterion; and awarding the bonus amount to selected machine.

29. The method of claim 28 wherein the criterion includes the total coins played, the method farther including the steps of:

monitoring the number of coins played from each of the machines;

incrementing a common counter by the number of coins played from each of the machines; and selecting the machine at which the coins were played that caused the common counter to match the criterion established.

30. The method of claim 28 wherein the common display device is a plasma-based flat panel display.

31. The method of claim 28 further including the step of displaying a status message on the selected gaming machine responsive to the bonus.

* * * * *

UNITED STATES PATENT AND TRADEMARK OFFICE

CERTIFICATE OF CORRECTION

PATENT NO. : 6,375,567 B1
DATED : April 23, 2002
INVENTOR(S) : Acres

It is certified that error appears in the above-identified patent and that said Letters Patent is hereby corrected as shown below:

Column 7,
Line 26, “The, triggering” should read -- The triggering --.

Column 12,
Line 31, “said gaining machines” should read -- said gaming machines --.

Column 15,
Line 17, “to selected machine.” should read -- to said selected machine. --.

Column 16,
Line 2, “method farther including” should read -- method further including --.

Signed and Sealed this

Sixth Day of January, 2004

JAMES E. ROGAN
*Director of the United States Patent and Trademark Office*

US006375567C1

(12) EX PARTE REEXAMINATION CERTIFICATE (5968th)

United States Patent

Acres

(10) Number: US 6,375,567 C1

(45) Certificate Issued: Oct. 23, 2007

(54) METHOD AND APPARATUS FOR IMPLEMENTING IN VIDEO A SECONDARY GAME RESPONSIVE TO PLAYER INTERACTION WITH A PRIMARY GAME

(75) Inventor: John F. Acres, Corvallis, OR (US)

(73) Assignee: IGT, Reno, NV (US)

Reexamination Request:
No. 90/007,269, Oct. 25, 2004

Reexamination Certificate for:

| | |
|---|---|
| Patent No.: | **6,375,567** |
| Issued: | **Apr. 23, 2002** |
| Appl. No.: | **09/104,145** |
| Filed: | **Jun. 23, 1998** |

Certificate of Correction issued Jan. 6, 2004.

Related U.S. Application Data

(60) Provisional application No. 60/083,299, filed on Apr. 28, 1998.

(51) Int. Cl.
*G07F 17/32* (2006.01)

(52) U.S. Cl. ..... 463/25; 463/16; 463/26; 463/27; 463/40

(58) Field of Classification Search ..... 463/16–20, 463/25–28, 40–42
See application file for complete search history.

(56) References Cited

U.S. PATENT DOCUMENTS

| | | | |
|---|---|---|---|
| 3,998,309 | A | 12/1976 | Mandas et al. |
| 4,238,127 | A | 12/1980 | Lucero et al. |
| 4,277,064 | A | 7/1981 | Newman |
| 4,448,419 | A | 5/1984 | Telnaes |
| 4,573,681 | A | 3/1986 | Okada |
| 4,624,459 | A | 11/1986 | Kaufman |
| 4,636,951 | A | 1/1987 | Harlick |
| 4,669,731 | A | 6/1987 | Clarke |
| 4,743,024 | A | 5/1988 | Helm et al. |
| 4,760,527 | A | 7/1988 | Sidley |
| 4,837,728 | A | 6/1989 | Barrie et al. |
| 4,842,278 | A | 6/1989 | Markowicz |
| 4,926,327 | A | 5/1990 | Sidley |
| 5,048,833 | A | 9/1991 | Lamle |
| 5,074,559 | A | 12/1991 | Okada |

(Continued)

FOREIGN PATENT DOCUMENTS

| | | |
|---|---|---|
| AU | 524709 | 8/1979 |
| AU | 39363/78 | 3/1980 |
| AU | 53370/86 | 8/1986 |
| AU | 628330 | 11/1989 |
| AU | B-42326189 | 3/1990 |
| AU | 633469 | 1/1993 |
| AU | 20986/92 | 1/1993 |
| AU | 668248 | 7/1994 |
| AU | 680920 | 8/1995 |
| AU | 704365 | 4/1997 |

(Continued)

OTHER PUBLICATIONS

Konami All Products Catalogue 1998.
Konami Amusement Machine Catalogue 1998.

(Continued)

*Primary Examiner*—Michael O'Neill

(57) ABSTRACT

A method for operating a group of gaming machines interconnected by a network to play both primary and secondary games from the machines. Each of the gaming machines has a primary game associated with it. Play is allowed to occur on the gaming machines while a triggering event is detected. In a preferred embodiment, the triggering event is detected by monitoring an operating parameter of the gaming machines over the network, such as total coins played. A predetermined criterion or threshold is set for the operating parameter and, if the operating parameter meets the predetermined criterion, a triggering event signal is sent through the network. Upon the occurrence of the triggering event, a secondary game is initiated from a selected one of the gaming machines whereby the secondary game is common to the group of gaming machines.

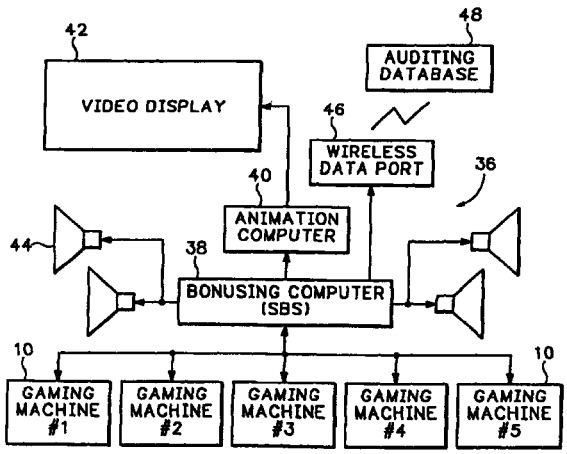

U.S. PATENT DOCUMENTS

| | | | | |
|---|---|---|---|---|
| 5,116,055 | A | | 5/1992 | Tracy |
| 5,123,649 | A | | 6/1992 | Tiberio |
| 5,152,529 | A | | 10/1992 | Okada |
| 5,158,293 | A | | 10/1992 | Mullins |
| 5,209,479 | A | | 5/1993 | Nagao et al. |
| 5,249,800 | A | | 10/1993 | Hilgendorf et al. |
| 5,259,616 | A | | 11/1993 | Bergmann |
| 5,276,312 | A | | 1/1994 | McCarthy |
| 5,280,909 | A | | 1/1994 | Tracy |
| 5,292,127 | A | | 3/1994 | Kelly et al. |
| 5,342,049 | A | | 8/1994 | Wichinsky et al. |
| 5,370,399 | A | | 12/1994 | Liverance |
| 5,377,993 | A | | 1/1995 | Josephs |
| 5,393,057 | A | * | 2/1995 | Marnell, II ..... 463/13 |
| 5,401,024 | A | | 3/1995 | Simunek |
| 5,423,539 | A | | 6/1995 | Nagao |
| 5,524,888 | A | | 6/1996 | Heidel |
| 5,564,700 | A | | 10/1996 | Celona |
| 5,566,337 | A | | 10/1996 | Szymanski et al. |
| 5,570,885 | A | | 11/1996 | Ornstein |
| 5,580,053 | A | | 12/1996 | Crouch |
| 5,580,309 | A | | 12/1996 | Piechowiak et al. |
| 5,581,011 | A | | 12/1996 | D'Ambra |
| 5,586,937 | A | | 12/1996 | Menashe |
| 5,601,487 | A | | 2/1997 | Oshima et al. |
| 5,611,535 | A | | 3/1997 | Tiberio |
| 5,611,730 | A | | 3/1997 | Weiss |
| 5,626,341 | A | | 5/1997 | Jones et al. |
| 5,645,486 | A | | 7/1997 | Nagao et al. |
| 5,702,304 | A | | 12/1997 | Acres et al. |
| 5,707,285 | A | | 1/1998 | Place et al. |
| 5,722,891 | A | | 3/1998 | Inoue |
| 5,743,798 | A | | 4/1998 | Adams et al. |
| 5,743,800 | A | | 4/1998 | Huard et al. |
| 5,758,875 | A | | 6/1998 | Giacalone, Jr. |
| 5,762,552 | A | | 6/1998 | Vuong et al. |
| 5,766,076 | A | | 6/1998 | Pease et al. |
| 5,769,716 | A | | 6/1998 | Saffari et al. |
| 5,770,533 | A | | 6/1998 | Franchi |
| 5,772,509 | A | | 6/1998 | Weiss |
| 5,772,511 | A | | 6/1998 | Smeltzer |
| 5,775,692 | A | | 7/1998 | Watts et al. |
| 5,779,545 | A | | 7/1998 | Berg et al. |
| 5,779,549 | A | | 7/1998 | Walker et al. |
| 5,788,573 | A | | 8/1998 | Baerlocher et al. |
| 5,806,855 | A | | 9/1998 | Cherry |
| 5,807,172 | A | | 9/1998 | Piechowiak |
| 5,816,918 | A | | 10/1998 | Kelly et al. |
| 5,820,459 | A | | 10/1998 | Acres et al. |
| 5,833,538 | A | | 11/1998 | Weiss |
| 5,833,540 | A | | 11/1998 | Miodunski et al. |
| 5,851,148 | A | | 12/1998 | Brune et al. |
| 5,851,149 | A | | 12/1998 | Xidos et al. |
| 5,855,514 | A | | 1/1999 | Kamille |
| 5,855,515 | A | | 1/1999 | Pease et al. |
| 5,876,284 | A | | 3/1999 | Acres et al. |
| 5,882,261 | A | | 3/1999 | Adams |
| 5,885,158 | A | * | 3/1999 | Torango et al. ..... 463/27 |
| 5,910,048 | A | | 6/1999 | Feinberg |
| 5,917,725 | A | | 6/1999 | Thacher et al. |
| 5,941,773 | A | | 8/1999 | Harlick |
| 5,947,821 | A | | 9/1999 | Stone |
| 5,947,822 | A | | 9/1999 | Weiss |
| 5,951,011 | A | | 9/1999 | Potter et al. |
| 5,989,121 | A | | 11/1999 | Sakamoto |
| 6,007,427 | A | | 12/1999 | Wiener et al. |
| 6,012,982 | A | | 1/2000 | Piechowiak et al. |
| 6,033,307 | A | | 3/2000 | Vancura |
| 6,039,648 | A | | 3/2000 | Guinn et al. |
| 6,039,649 | A | | 3/2000 | Schulze |
| 6,048,269 | A | | 4/2000 | Burns et al. |
| 6,050,895 | A | | 4/2000 | Luciano, Jr. et al. |
| 6,059,659 | A | | 5/2000 | Busch et al. |
| 6,068,553 | A | | 5/2000 | Parker |
| 6,077,162 | A | | 6/2000 | Weiss |
| 6,080,062 | A | | 6/2000 | Olson |
| 6,089,976 | A | | 7/2000 | Schneider et al. |
| 6,089,977 | A | | 7/2000 | Bennett |
| 6,089,980 | A | | 7/2000 | Gauselmann |
| 6,110,041 | A | | 8/2000 | Walker et al. |
| 6,110,043 | A | | 8/2000 | Olsen |
| 6,117,013 | A | | 9/2000 | Eiba |
| 6,126,542 | A | | 10/2000 | Fier |
| 6,135,884 | A | | 10/2000 | Hedrick et al. |
| 6,139,431 | A | * | 10/2000 | Walker et al. ..... 463/20 |
| 6,142,872 | A | | 11/2000 | Walker et al. |
| 6,146,270 | A | | 11/2000 | Huard et al. |
| 6,146,273 | A | | 11/2000 | Olsen |
| 6,179,711 | B1 | | 1/2001 | Yoseloff |
| 6,210,275 | B1 | | 4/2001 | Olsen |
| 6,224,484 | B1 | | 5/2001 | Okuda et al. |
| 6,234,896 | B1 | | 5/2001 | Walker et al. |
| 6,238,288 | B1 | | 5/2001 | Walker et al. |
| 6,241,608 | B1 | | 6/2001 | Torango |
| 6,244,958 | B1 | | 6/2001 | Acres |
| 6,254,483 | B1 | | 7/2001 | Acres |
| 6,287,194 | B1 | | 9/2001 | Okada et al. |
| 6,287,202 | B1 | | 9/2001 | Pascal et al. |
| 6,302,794 | B1 | | 10/2001 | Ogawa |
| 6,319,125 | B1 | | 11/2001 | Acres |
| 6,364,768 | B1 | | 4/2002 | Acres et al. |
| 6,375,569 | B1 | | 4/2002 | Acres |
| 6,398,218 | B1 | | 6/2002 | Vancura |
| 6,435,968 | B1 | | 8/2002 | Torango |
| 6,511,376 | B2 | | 1/2003 | Walker et al. |
| 6,533,664 | B1 | | 3/2003 | Crumby |
| 6,572,471 | B1 | | 6/2003 | Bennett |
| 6,592,460 | B2 | | 7/2003 | Torango |
| 6,921,334 | B1 | | 7/2005 | Bennett |
| 6,984,173 | B1 | | 1/2006 | Piechowiak et al. |
| 2001/0049303 | A1 | | 12/2001 | Found et al. |

FOREIGN PATENT DOCUMENTS

| | | | |
|---|---|---|---|
| AU | 704372 | | 4/1997 |
| AU | 70247/96 | | 4/1997 |
| AU | 680602 | | 7/1997 |
| AU | 716299 | | 1/1998 |
| AU | 199662115 | | 2/1998 |
| AU | 722107 | | 5/1998 |
| AU | A-43615/97 | | 5/1998 |
| AU | 721968 | | 6/1998 |
| AU | 748263 | | 11/1998 |
| CA | 2151990 | | 12/1995 |
| CA | 2238678 | | 2/1999 |
| DE | 3415114 | | 10/1985 |
| DE | 3917683 | | 12/1990 |
| DE | 4200254 | | 8/1993 |
| EP | 0342797 | | 11/1989 |
| EP | 0420586 | | 4/1991 |
| EP | 0770415 | A2 | 5/1997 |
| GB | 1242298 | | 8/1971 |
| GB | 1284898 | | 8/1972 |
| GB | 2099198 | | 12/1982 |
| GB | 2153572 | | 8/1985 |
| GB | 2169737 | A | 7/1986 |
| GB | 2181589 | | 4/1987 |
| GB | 2191030 | A | 12/1987 |
| GB | 2231189 | | 11/1990 |
| GB | 2282690 | | 4/1995 |
| JP | 06079055 | | 3/1994 |
| WO | WO8002512 | | 11/1980 |

| | | |
|---|---|---|
| WO | WO96/08295 | 3/1996 |
| WO | 97/12315 | 4/1997 |
| WO | WO9727568 | 7/1997 |
| WO | WO 98/07484 | 2/1998 |
| WO | WO9818532 | 5/1998 |
| WO | WO9847115 | 10/1998 |
| WO | WO9903078 | 1/1999 |
| WO | WO9910849 | 3/1999 |

OTHER PUBLICATIONS

Regan, "The Basics About Playing Today's Slots,"*Winning At Slot Machines*, Carol Publishing Group, New York, NY, Chapter 4 (1994).

Ortiz, "Slot Machines,"*Darwin Ortiz On Casino Gambling: The Complete Guide To Playing and Winning*, Carol Publishing Group, New York, NY, Chapter 9 (1986).

Gollehon, *All About Slots and Video Poker*, The Berkley Publishing Group, New York, NY, Chapters 1, 4, 5, 6, 7, and 8 (1985).

*Action Jackpots*, Brochure (1996).

U.S. Appl. No. 60/035,513, filed Jan. 15, 1997, Torango et al.

U.S. Appl. No. 60/040,982, filed Mar. 17, 1997, Torango et al.

U.S. Appl. No. 60/050,971, filed Jun. 19, 1997, Torango et al.

Court's Ruling on Claim Construction in *Cynthia Jean Goff* v. *Harrah's Operating Company, Inc. et al.,* dated Dec. 30, 2005.

Plaintiff Torango's Supplemental Response to Defendant Aristocrat Technologies, Inc.'s First Set of Interrogatories, US District Court the District Court of Nevada, No. CV–N–03–0690–HDM–RAM, Aug. 19, 2004.

Statement of Ground and Particulars in Support of Opposition, May 21, 2003.

Statutory Declaration of John Boris Golja, Australia, May 21, 2004.

Statutory Declaration of Phillip Charles Dimond.

Statutory Declaration of Scott Olive, Australia, May 9, 2005.

Supplemental Interrogatory Response in *Torango* v. *Aristocrat*, served on Dec. 14, 2004.

Surprize Gaming Machine Avertisement, Aristocrat Leisure Industries, Australia.

Surprize Software Specification for MV2030 – var 01, Aristocrat Leisure Industries, Australia.

Australia/New Zealand Gaming Machine National Standards, Revision 1.0, 127 pp. (Dec. 1997).

Excerpt from Mikohn "Product Catalog," Chapters 1, 2, 6, 7, and 8, 64 pgs. (Jan. 1993).

Legato, "World of Slots," Casino Journal, vol. 9, No. 10, pp. 70–98, 145–146 (Oct. 1996).

New South Wales, "Approved Poker Machines," 88 pp. (Mar. 1995).

New South Wales, "Linked Progressive Jackpot Systems," 61 pp. (Mar. 1995).

Queensland Treasury Office of Gaming Regulation Local Area Electronic Gaming Machine Communications Protocol, "QCOM," Version 1.5, 77 pp. (Feb. 1998).

Victoria, "Review of VCGA SRD for Gaming Equipment (Version 4.0) With Regard to Gaming Machine National Standards," Revision 1.0, 72 pp. (Dec. 1997).

Victorian Casino and Gaming Authority, "Technical Requirements for Gaming Machines and Electronic Monitoring Systems in the Melbourne Casino," Version 3.0, 84 pp. (Jul. 10, 1996).

Aristocrat Advantage Buyer's Guide, Mar.–May 1989, published by Aristocrat (hereinafter "ACES ad").

Aristocrat, "Catalogue of Champions," 4 pgs. (1990).

Bueschel, "Lemons, Cherries and Bell–Fruit–Gum," Royal Bell Books (1995).

"Clubs Now Have a Sporting Chance," Slotworld Magazine, vol. 5, No. 6, pp. 16–17 (including Aristocrat insert) (Jun. 1992).

Computa Game—The Software Manual, Revision 3.

Derby Day and Action Jackpots pamphlets from Atronic Casino Technology, 1996, 2 pp. ("Derby Day and Action Jackpots Pamphlets").

Fey, "Slot Machines: A Pictorial History of the First 100 Years, Fourth Edition," Liberty Bell Books (1994).

Legato, "Aristocrat Leisure Industries," Casino Journal, vol. 10, No. 1, pp. 87–89 (Jan. 1997).

Press Release from New York–New York and Mikohn entitled "New York–New York Hotel & Casino Unveils New MONEYTIME Slot Jackpot Spectacular From Mikohn," Jul. 16, 1997 ("MONEYTIME Press Release").

Queensland Treasury Office of Gaming Regulation, Local Area Electronic Gaming Machine Communication Protocol, Version 1.2 (Mar. 26, 1997).

"Video Poker Mania!," Goliehon Press, Inc., pp. 48–75 (1991).

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 4, 5, 7, 9, 10, 12 and 29 is confirmed.

Claims 1–3, 6, 8, 11, 13–25, 28, 30 and 31 are cancelled.

Claims 26 and 27 are determined to be patentable as amended.

New claims 32–61 are added and determined to be patentable.

26. The method of claim 25 further comprising:

placing the selected gaming machine in a queue to play the secondary game responsive to the triggering event, wherein the [second] *secondary* game can be initiated from the selected gaming machine only if the selected machine is at the front of the queue; and awarding a secondary game bonus to the selected machine responsive to an outcome of the secondary game.

27. The method of claim 25 further comprising:

initiating a tertiary game responsive to the [secondary] *second* occurrence of the triggering event; and awarding the bonus to the selected gaming machine based on an outcome of the tertiary game.

*32. The method of claim 1 wherein the method further includes preventing play of the primary game on said one gaming machine during play of the secondary game.*

*33. The method of any claims 1–14 or 32 wherein the method further includes initiating the secondary game from one of the gaming machines.*

*34. The method of any of claims 2–14 wherein the method further includes preventing play of the primary game on said one gaming machine during play of the secondary game.*

*35. The method of claim 34 wherein said method further includes initiating the secondary game from one of the gaming machines.*

*36. An apparatus for selectively operating a plurality of gaming machines over a network, said apparatus comprising:*

*a plurality of gaming machines for playing a primary game thereon;*

*an actuator coupled to each of the gaming machines for selective activation of the primary game by a player at a respective gaming machine;*

*a secondary game controller;*

*a network coupled to the gaming machines and the controller for exchanging data between the secondary game controller and the gaming machines;*

*a secondary game adapted to be enabled for play responsive to signals from the secondary game controller;*

*a deactivation circuit structured and arranged to prevent play of the primary game on the selected gaming machine during play of the secondary game;*

*wherein the secondary game controller monitors the activity of the gaming machines over the network and enables the secondary game for play when an operating parameter meets a predetermined criterion, the apparatus further including*

*means for selecting one of the plurality of gaming machines when the operating parameter meets the criterion; and*

*means on said selected machine for initiating said secondary game, wherein said secondary game controller applies a first bonus to the selected machine responsive to an outcome of the secondary game.*

*37. The apparatus of claim 36 wherein said deactivation circuit is constructed and arranged to selectively permit said actuator to initiate the secondary game responsive to a signal generated by the secondary game controller.*

*38. The apparatus of any of claims 16–23 wherein said apparatus further includes a deactivation circuit structured and arranged to prevent play of the primary game on the selected gaming machine during play of the secondary game.*

*39. A method for operating a gaming machine comprising the steps of:*

*allowing play to occur on the gaming machine;*

*detecting a triggering event based on a first criterion;*

*measuring a rate of play at the gaming machine;*

*awarding a bonus after a second occurrence of the triggering event if the measured rate of play at the gaming machine meets a predetermined criterion;*

*allowing play to occur at a plurality of other gaming machines;*

*initiating a secondary game from a selected one of the gaming machines responsive to the triggering event; and*

*wherein the gaming machine has a primary game and wherein the method further includes preventing play of the primary game during play of the secondary game.*

*40. A method for operating a gaming machine comprising the steps of:*

*allowing play to occur on the gaming machine;*

*detecting a triggering event based on a first criterion;*

*measuring a rate of play at the gaming machine;*

*awarding a bonus after a second occurrence of the triggering event if the measured rate of play at the gaming machine meets a predetermined criterion;*

*allowing play to occur at a plurality of other gaming machines;*

*initiating a secondary game from a selected one of the gaming machines responsive to the triggering event;*

*placing the selected gaming machine in a queue to play the secondary game responsive to the triggering event, wherein the secondary game can be initiated from the selected gaming machine only if the selected machine is at the front of the queue; and*

*awarding a secondary game bonus to the selected machine responsive to an outcome of the secondary game, wherein the gaming machine has a primary game and wherein the method further includes preventing play of the primary game during play of the secondary game.*

*41. A method for operating a gaming machine comprising the steps of:*

*allowing game play to occur on the gaming machine;*

*detecting a triggering event based on a first criterion;*

*awarding a first bonus responsive to the triggering event;*

*measuring a rate of play at the gaming machine;*

*awarding a second bonus after a second occurrence of the triggering event if the measured rate of play at the gaming machine meets a predetermined criterion;*

*allowing play to occur at a plurality of other gaming machines;*

*initiating a secondary game from a selected one of the gaming machines responsive to the first occurrence of the triggering event;*

*placing the selected gaming machine in a queue to play the secondary game responsive to the first occurrence of the triggering event, wherein the secondary game can be initiated from selected gaming machine only if the selected machine is at the front of the queue; and*

*awarding the first bonus to the selected machine responsive to an outcome of the secondary game.*

*42. A method for operating a gaming machine comprising the steps of:*

*allowing game play to occur on the gaming machine;*

*detecting a triggering event based on a first criterion;*

*awarding a first bonus responsive to the triggering event;*

*measuring a rate of play at the gaming machine;*

*awarding a second bonus after a second occurrence of the triggering event if the measured rate of play at the gaming machine meets a predetermined criterion;*

*allowing play to occur at a plurality of other gaming machines;*

*initiating a secondary game from a selected one of the gaming machines responsive to the first occurrence of the triggering event;*

*initiating a tertiary game responsive to the second occurrence of the triggering event; and*

*awarding the second bonus to the selected gaming machine based on an outcome of the tertiary game.*

*43. A method for operating a gaming machine configured to play a primary game comprising the steps of:*

*providing a plurality of gaming machines having a primary game associated therewith;*

*coupling the gaming machines to a common video display device;*

*displaying a bonus amount on the video display device;*

*permitting players to play the primary game at the gaming machines;*

*monitoring at least one variable related to user-controlled play on the gaming machines;*

*establishing a predetermined criterion for said one variable;*

*selecting one of the machines when said one variable meets the criterion;*

*awarding the bonus amount to the selected machine;*

*enabling a secondary game for play when said one variable meets the criterion;*

*permitting play of the secondary game at the selected machine;*

*awarding the bonus amount to the selected machine as a secondary game outcome; and*

*preventing play of the primary game at the selected machine during play of the secondary game.*

*44. The method of claim 43 wherein the method further includes enabling one secondary game for play.*

*45. A method for operating a gaming machine configured to play a primary game comprising the steps of:*

*providing a plurality of gaming machines having a primary game associated therewith;*

*coupling the gaming machines to a common video display device;*

*displaying a bonus amount on the video display device;*

*permitting players to play the primary game at the gaming machines;*

*monitoring at least one variable related to user-controlled play on the gaming machines;*

*establishing a predetermined criterion for said one variable, the criterion including the total coins played;*

*selecting one of the machines when said one variable meets the criterion; and*

*awarding the bonus amount to the selected machine;*

*monitoring the number of coins played from each of the machines;*

*incrementing a common counter by the number of coins played from each of the machines;*

*selecting the machine at which the coins were played that caused the common counter to match the criterion established;*

*enabling a secondary game for play when said one variable meets the criterion;*

*permitting play of the secondary game at the selected machine; and*

*awarding the bonus amount as a secondary game outcome.*

*46. The method of claim 45 wherein the method further includes preventing play of the primary game at the selected machine during play of the secondary game.*

*47. The method of claim 45 wherein the method further includes enabling one secondary game for play.*

*48. The method of claim 32 wherein the triggering event is related to a primary-game wager made on said one gaming machine and wherein the triggering event is independent of the outcome of the primary game on said one gaming machine.*

*49. The method of claim 48 wherein said one gaming machine includes an actuator for playing the primary game and wherein the method further includes playing the secondary game with the actuator.*

*50. The method of claim 48 wherein the first bonus comprises a prize that is determined at least in part as a result of a random process.*

*51. The method of claim 50 wherein the method further includes indicating an outcome of the secondary game at least in part with an animated wheel.*

*52. The method of claim 50 wherein the first bonus prize is selected from among a plurality of prizes.*

*53. The method of claim 50 wherein the triggering event is based at least in part on a random process.*

*54. The method of claim 50 wherein the method further includes:*

*generating the triggering event based at least in part on selecting a random number from within a range of numbers; and*

*indicating an outcome of the secondary game at least in part with an animated wheel.*

*55. The method of claim 33 wherein the triggering event is related to a primary-game wager made on said one gaming machine and wherein the triggering event is independent of the outcome of the primary game on said one gaming machine.*

*56. The method of claim 55 wherein the first bonus comprises a prize that is determined at least in part as a*

*result of a random process and the triggering event is based at least in part on selecting a random number from within a range of numbers.*

*57. The apparatus of claim 38 wherein said deactivation circuit is constructed and arranged to selectively permit said actuator to play the secondary game responsive to a signal generated by the secondary game controller.*

*58. A method for operating a gaming machine comprising the steps of:*

*allowing play to occur on the gaming machine;*

*detecting a triggering event based on a first criterion;*

*measuring a rate of play at the gaming machine;*

*awarding a bonus after a second occurrence of the triggering event if the measured rate of play at the gaming machine meets a predetermined criterion;*

*allowing play to occur at a plurality of other gaming machines;*

*initiating a secondary game from a selected one of the gaming machines responsive to the triggering event;*

*initiating a tertiary game responsive to the second occurrence of the triggering event; and*

*awarding the bonus to the selected gaming machine based on an outcome of the tertiary game, wherein the gaming machine has a primary game and wherein the method further includes preventing play of the primary game during play of the secondary game.*

*59. A method for operating a gaming machine comprising the steps of;*

*allowing play to occur on the gaming machine;*

*detecting a triggering event based on a first criterion;*

*measuring a rate of play at the gaming machine; and*

*awarding a bonus after a second occurrence of the triggering event if the measured rate of play at the gaming machine meets a predetermined criterion;*

*allowing play to occur at a plurality of other gaming machines;*

*initiating a secondary game from a selected one of the gaming machines responsive to the triggering event;*

*placing the selected gaming machine in a queue to play the secondary game responsive to the triggering event, wherein the secondary game can be initiated from the selected gaming machine only if the selected machine is at the front of the queue; and*

*awarding a secondary game bonus to the selected machine responsive to an outcome of the secondary game.*

*60. A method for operating a gaming machine comprising the steps of:*

*allowing play to occur on the gaming machine;*

*detecting a triggering event based on a first criterion;*

*measuring a rate of play at the gaming machine; and*

*awarding a bonus after a second occurrence of the triggering event if the measured rate of play at the gaming machine meets a predetermined criterion.*

*allowing play to occur at a plurality of other gaming machines;*

*initiating a secondary game from a selected one of the gaming machines responsive to the triggering event;*

*initiating a tertiary game responsive to the second occurrence of the triggering event; and*

*awarding the bonus to the selected gaming machine based on an outcome of the tertiary game.*

*61. A method for operating a gaming machine configured to play a primary game comprising the steps of:*

*providing a plurality of gaming machines having a primary game associated therewith;*

*coupling the gaming machines to a common video display device;*

*displaying a bonus amount on the video display device;*

*permitting player to play the primary game at the gaming machines;*

*monitoring at least one variable related to user-controlled play on the gaming machines;*

*establishing a predetermined criterion for said one variable, the criterion including the total coins played;*

*selecting one of the machines when said one variable meets the criterion;*

*awarding the bonus amount to the selected machine;*

*monitoring the number of coins played from each of the machines;*

*incrementing a common counter by the number of coins played from each of the machines; and*

*selecting the machine at which the coins were played that caused the common counter to match the criterion established.*

* * * * *